United States Patent [19]

Kaufman

[11] 4,364,846

[45] Dec. 21, 1982

[54] PROCESS FOR PREPARING A HAZE-FREE DETERGENT AND CORROSION INHIBITING ADDITIVE FOR MOTOR FUELS

[75] Inventor: Benjamin J. Kaufman, Wappingers Falls, N.Y.

[73] Assignee: Texaco Inc., White Plains, N.Y.

[21] Appl. No.: 248,169

[22] Filed: Mar. 30, 1981

[51] Int. Cl.[3] ..... C23F 11/12; C23F 11/14

[52] U.S. Cl. ..... 252/392; 44/63; 44/71; 562/561; 252/393; 252/394

[58] Field of Search ..... 44/63, 71; 252/404, 252/392; 260/45.95 F; 562/561

[56] References Cited

U.S. PATENT DOCUMENTS 4,062,874 12/1977 Sciaraffa et al. ..... 260/346.76

4,207,079 6/1980 Herbstman et al. ..... 44/71

*Primary Examiner*—Charles F. Warren

*Assistant Examiner*—Y. Harris-Smith

*Attorney, Agent, or Firm*—Carl G. Ries; Robert A. Kulason; James J. O'Loughlin

[57] ABSTRACT

A method is provided for preventing haze formation in a carburetor detergent and corrosion inhibiting fuel additive which is prepared by reacting a mole of maleic anhydride with from about 2 to 4 moles of a mixture of N-alkyl propane diamines of a specific alkyl chain distribution in the presence of from about 0.5 to 5 weight percent based on the N-alkyl propane diamine mixture of a phenolic antioxidant.

3 Claims, No Drawings

PROCESS FOR PREPARING A HAZE-FREE DETERGENT AND CORROSION INHIBITING ADDITIVE FOR MOTOR FUELS

BACKGROUND OF THE INVENTION

1. Field of Invention

Gasoline compositions are highly refined products. Despite this, they contain minor amounts of impurities which can promote corrosion during the period that the fuel is transported in bulk or held in storage. Corrosion can also occur in the fuel tank, fuel lines and carburetor of a motor vehicle. As a result, a commercial motor fuel composition must contain a corrosion inhibitor to inhibit or prevent corrosion.

Internal combustion engine design is also undergoing changes to meet new standards for engine exhaust gas emissions. One design change involves the feeding of blow-by gases from the crankcase zone of the engine into the intake air supply to the carburetor rather than venting these gases to the atmosphere as in the past. Another change involves recycling part of the exhaust gases to the combustion zone of the engine in order to minimize objectionable emissions. Both the blow-by gases from the crankcase zone and the recycled exhaust gases contain significant amounts of deposit-forming substances which promote the formation of deposits in and around the throttle plate area of the carburetor. These deposits restrict the flow of air through the carburetor at idle and at low speeds so that an overrich fuel mixture results. This condition produces rough engine idling or stalling causing an increase in the amount of polluting exhaust gas emissions, which the engine design changes were intended to overcome, and also decreases fuel efficiency. The conventional method for overcoming these problems is to employ a detergent fuel additive in commercial motor fuel compositions.

Primary aliphatic hydrocarbon amino alkylene-substituted asparagines are useful as multi-functional fuel additives. They inhibit corrosion as well as exhibit carburetor detergency properties. These asparagines are produced by reacting maleic anhydride with an N-alkylpropane diamine. In actual practice, maleic anhydride is reacted with a mixture of N-alkyl-propanediamines in which the N-alkyl group constitutes a mixture of alkyl radicals having from 12 to 18 carbon atoms. An illustration of this reaction is shown in U.S. Pat. No. 4,207,079 wherein a mixture of N-alkylpropanediamines marketed under the tradename "Duomeen O", is reacted with maleic anhydride to produce the desired primary aliphatic hydrocarbon amino alkylene-substituted asparagines.

In general, a mole of N-alkylpropanediamine is initially reacted with a mole of maleic anhydride dissolved in an organic solvent, such as diluent oil. Following the initial reaction step, the reaction mixture is cooled to a temperature of below 80° C. and a second mole of the N-alkyl-propane-diamine is added to the reaction mixture. The temperature of the reaction mixture is then raised to 100° C. and the mixture heated for two hours. For reasons that are not fully understood but which are believed to be related to impurities in commercial grades of N-alkylpropanediamines, the resulting primary aliphatic hydrocarbon amino alkyl-substituted asparagine is hazy or becomes hazy on standing and often a precipitate forms in the reaction product mixture. The presence of haze or a precipitate in the reaction product precludes its use commercially as an additive in fuels, and is therefore undesirable.

Thus, a need arises for an improved process for reacting maleic anhydride with an N-alkylpropanediamine mixture in the manufacture of an aliphatic hydrocarbon amino alkylene-substituted asparagine product which is not hazy and will not become hazy or form a precipitate on standing.

An object of this invention is to provide an improved process for reacting maleic anhydride with an N-alkyl propane diamines mixture which prevents haze formation or reduces it to an acceptable level in the product. A specific object of this invention is to provide a process for reacting maleic anhydride with an N-alkyl propane diamine mixture in the presence of a phenolic anti-oxidant.

2. Description of the Prior Art

U.S. Pat. No. 4,207,079 discloses a process for making a carburetor detergent and corrosion inhibitor reaction product by reacting maleic anhydride with an N-alkyl alkylene diamine to form a primary aliphatic hydrocarbon amino alkylene substituted asparagine. The process disclosed for making such a reaction product involves suspending the appropriate amount of maleic anhydride in an oil or an inert hydrocarbon solvent such as xylene and then adding the amine to the solution. The disclosure in U.S. Pat. No. 4,207,079 is incorporated herein by reference.

Also U.S. Pat. No. 4,062,874 discloses heat stabilization of maleic anhydride by phenolic compounds.

SUMMARY OF THE INVENTION

It has now been discovered that the reaction between maleic anhydride and an N-alkylpropanediamine mixture can be modified so that the resulting primary aliphatic hydrocarbon amino alkylene-substituted asparagine is not hazy and does not form a haze or a precipitate on standing. More specifically, it has been discovered that the reaction between maleic anhydride and an N-alkylpropanediamines mixture can be surprisingly improved to produce a non-haze forming or non-precipitate forming primary aliphatic hydrocarbon amino alkylene-substituted asparagine by effecting the reaction in the presence of a phenolic compound represented by the formula:

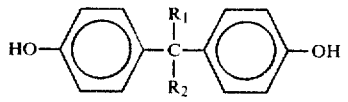

wherein $R_1$ and $R_2$ are independently hydrogen or alkyl groups of from 1 to 9 carbon atoms and $R_1$ and $R_2$ contain a total of 0 to 9 carbon atoms. $R_1$—C—$R_2$ can also be viewed as a methylene group when both $R_1$ and $R_2$ are hydrogen or when at least one of $R_1$ and $R_2$ is an alkyl group, $R_1$—C—$R_2$ is an alkylidene group of from 2 to 10 carbon atoms.

DESCRIPTION OF THE PREFERRED EMBODIMENT

In accordance with the process of this invention maleic anhydride and an N-alkyl alkylene diamine mixture having an N-alkyl group distribution of 0.5% dodecyl (C-12); 3.5% tetradecyl (C-14); 0.5% pentadecyl (C-15); 4.0% hexadecyl (C-16); 1.0% heptadecyl (C-17); 14.0% octadecyl (C-18); 1.5% tetradecenyl (C-14); 5.0% hexadecenyl (C-16); 67.0% octadecenyl (C-18); 3.0% octadecadienyl (C-18) are reacted in the presence of about 0.5 to 5 weight percent based on the N-alkyl propane diamine mixture of a phenolic anti-oxidant represented by the formula:

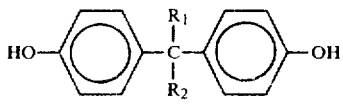

wherein $R_1$ and $R_2$ are independently hydrogen or an alkyl group having from 1 to 9 carbon atoms and the sum of the carbon atoms in $R_1$ and $R_2$ does not exceed 9 carbon atoms. The linking $R_1$—C—$R_2$ group can be viewed as a methylene group when both $R_1$ and $R_2$ are hydrogen or as an alkylidene group when at least one of $R_1$ and $R_2$ is an alkyl group. Examples of these are ethylidene, isopropylidene, propylidene and dodecylidene.

Examples of specific phenolic anti-oxidants which are effective in this reaction for producing non-haze forming aliphatic hydrocarbon amino alkylene-substituted asparagines include 4-tertiary-butylphenol, 4-tertiaryoctylphenol, paranonylphenol, paradecylphenol, paradodecylphenol, parastearylphenol, 4,4'-bisphenol-2,2'-propane (Bisphenol A), 4,4'-di(hydroxyphenyl) 2,2'-decane.

The alkyl diamine composition which can be employed in this process is represented by the formula:

$$R—NH—(CH_2)_3—NH_2$$

in which R is an alkyl radical having a chain distribution of 0.5% dodecyl (C-12); 3.5% tetradecyl (C-14); 0.5% pentadecyl (C-15); 4.0% hexadecyl (C-16); 1.0% heptadecyl (C-17); 14.0% octadecyl (C-18); 1.5% tetradecenyl (C-14); 5.0% hexadecenyl (C-16); 64.0% octadecenyl (C-18); 3.0% octadecadienyl (C-18). This material is marketed under the trademark "Duomeen 0" and is designated herein as Diamine A.

The anhydride which can be employed in this process is maleic anhydride.

The reaction is conducted by reacting approximately two to four moles of Diamine A with one mole of maleic anhydride to produce a primary aliphatic hydrocarbon amino alkylene-substituted asparagine for use as, or for the preparation of, a fuel or lubricating oil additive. A more preferred mole ratio for the reaction is the ratio of about 3 moles of Diamine A with about one mole of maleic anhydride.

This reaction can be conducted at a temperature in the range from 60° C. to 110° C. maximum, with the preferred reaction temperature being from about 60° to 100° C. The upper temperature limit in the preparation of the additive is critical. Higher temperatures especially above 110° C. cause the formation of succinimide compounds which have essentially no corrosion inhibiting properties for a motor fuel composition.

The novel process of this invention is based on the use of the prescribed phenolic anti-oxidants to prevent haze in the asparagine reaction product formed by maleic anhydride and Diamine A. This phenolic antioxidant is highly effective for reducing the formation of a haze or precipitate in the asparagine reaction product. The phenolic anti-oxidant is employed at a concentration ranging from about 0.5 weight percent to 5 weight percent based on the amount of Diamine A employed in the reaction.

A preferred phenolic anti-oxidant concentration is about 1 weight percent. The manner of introducing the phenolic anti-oxidant is not critical. It has been found convenient, however, to mix the anti-oxidant with the maleic anhydride in the diluent oil before adding the Diamine A.

The following examples illustrate the preparation of a primary aliphatic hydrocarbon amino alkylene substituted asparagine useful as a carburetor detergent and corrosion inhibitor in fuels and lubricants by the practice of this invention.

EXAMPLE I

A solution containing 261.7 grams of diluent oil having an SUS at 100° F. of 100 and 31.7 grams (0.32 moles) of maleic anhydride is heated to 60° C. 230 grams (0.67) moles) of Diamine A are added dropwise to the solution while maintaining the temperature below 80° C. No phenolic anti-oxidant haze inhibitor is added to this comparison example. After heating the mixture at 100° C. for 2 hours, the solution is cooled to 50° C. and filtered. The 517 grams of reaction product yielded either was hazy or became hazy on standing at room temperature for one month or on standing at 100° F. for one month. Often a phase separation occurred in this reaction product mixture.

The analysis of the reaction product by infrared spectroscopy revealed amine carboxylate salt absorption bands at 2100 to 2220 $cm^{-1}$ and an amide carbonyl stretching band at 1640 $cm^{-1}$. The infrared analysis also showed an absence of anhydride and succinimide bands.

EXAMPLE II

A solution containing 261.7 grams of diluent oil having an SUS at 100° F. of 100, 3.17 grams (0.32 moles) of maleic anhydride and 5.3 grams (0.023 moles) of 4,4'-bisphenol-2,2'-propane (Bisphenol A) is heated to 60° C. 230 grams (0.67 moles) of Diamine A are added dropwise to the solution while maintaining the temperature below 80° C. After heating the mixture at 100° C. for 2 hours, the solution is cooled to 50° C. and filtered, yielding 517 grams of a clear amber product which does not become hazy on standing under the same conditions as in Example I.

The above examples illustrate a novel process wherein the formation of haze in the reaction product of maleic anhydride and Diamine A is prevented by the addition of a phenolic anti-oxidant, more specifically 4,4'-bisphenol 2,2' propane (Bisphenol A). The marked reduction or prevention of haze formation by this process enhances the usefulness of the carburetor detergent produced thereby.

We claim:

1. In a method for preparing a primary aliphatic hydrocarbon alkylene substituted asparagine in which one mole of maleic anhydride is reacted with approximately two moles of a N-alkyl-propane diamine composition represented by the formula:

$$R—NH—(CH_2)_3—NH_2$$

in which the typical chain distribution of R is 0.5% dodecyl (C-12); 3.5% tetradecyl (C-14); 0.5% pentadecyl (C-15); 4.0% hexadecyl (C-16); 1.0% heptadecyl (C-17); 14.0% octadecyl (C-18); 1.5% tetradecenyl (C-14); 5.0% hexadecenyl (C-16); 67.0% (C-18): 3.0% octadecadienyl (C-18); and wherein said primary aliphatic hydrocarbon alkylene substituted asparagine product is characterized by being hazy or becoming hazy on standing, the improvement which comprises conducting said reaction between said maleic anhydride and said N-alkylpropane diamine composition in the presence of from about 0.5 to 5 weight percent based on the weight of N-alkyl propane diamine mixture of a phenolic compound represented by the formula:

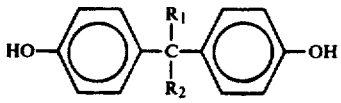

in which $R_1$ and $R_2$ each represent hydrogen or an alkyl radical having from 1 to 9 carbon atoms and the total number of carbon atoms in $R_1$ and $R_2$ does not exceed 9.

2. A method according to claim 1 in which said phenolic antioxidant is 4,4'-bisphenol-2,2' propane.

3. A method according to claim 1 in which the concentration of said phenolic antioxidant is about 1 weight percent based on N-alkyl propane diamine mixture.

* * * * *